United States Patent [19]

Bergstrom

[11] Patent Number: 5,046,894

[45] Date of Patent: Sep. 10, 1991

[54] BUOYANCY COMPENSATOR WITH INTERCHANGEABLE BACKPACK AND COMMERBUND

[75] Inventor: Neil R. Bergstrom, La Mesa, Calif.

[73] Assignee: Soniform, Inc., El Cajon, Calif.

[21] Appl. No.: 551,909

[22] Filed: Jul. 12, 1990

[51] Int. Cl.[5] ..... B63C 11/30; B63C 11/02

[52] U.S. Cl. ..... 405/186; 441/106; 441/114

[58] Field of Search ..... 405/185, 186; 441/106, 441/108, 113–116; 128/202.14; 2/2.1 R

[56] References Cited

U.S. PATENT DOCUMENTS

| | | | |
|---|---|---|---|
| 3,105,359 | 10/1963 | Ellis | 2/2.1 R X |
| 4,114,389 | 9/1978 | Bohmrich et al. | 405/186 |
| 4,137,585 | 2/1979 | Wright . | |
| 4,523,914 | 6/1985 | Faulconer et al. | 441/108 |
| 4,561,853 | 12/1985 | Faulconer et al. | 441/106 |
| 4,694,772 | 9/1987 | Faulconer et al. | 114/315 |
| 4,752,263 | 6/1988 | Pritchard et al. | 441/88 |
| 4,778,307 | 10/1988 | Faulconer | 405/186 |
| 4,779,554 | 10/1988 | Courtney | 405/186 |
| 4,810,134 | 3/1989 | Eaulconer et al. | 405/186 |
| 4,887,932 | 12/1989 | Toth | 405/186 |
| 4,913,589 | 4/1990 | Faulconer et al. | 405/186 |

OTHER PUBLICATIONS

Sea Quest catalog showing adjustable hard backpack.

Sherwood catalog showing air-cell with adjustable hard backpack.

*Primary Examiner*—Dennis L. Taylor

*Assistant Examiner*—John Ricci

[57] ABSTRACT

A buoyancy compensator is provided with replaceable elements which enable a user to change the tank support system and the cummerbund. The buoyancy compensator includes a vest which can be removably attached to a hard backpack or a soft backpack. A cummerbund for encircling the waist of the user can be removably attached to either the hard backpack or the soft backpack. The cummerbund includes a flexible attaching strap which has one end secured to the cummerbund, and the other end of the attaching strap is removably secured to the cummerbund by hook and loop fasteners. The attaching strap is threaded through slots in the rigid backpack or through a strap on the soft backpack.

16 Claims, 7 Drawing Sheets

BUOYANCY COMPENSATOR WITH INTERCHANGEABLE BACKPACK AND COMMERBUND

BACKGROUND

This invention relates to buoyancy compensators, and, more particularly, to a buoyancy compensator which includes interchangeable backpacks and cummerbunds.

Buoyancy compensators are commonly provided in a form similar to a life vest and include a bladder or air cell inside the vest. Buoyancy compensators are described, for example, in U.S. Pat. Nos. 4,810,134, 4,752,263, 4,694,772, 4,561,853, 4,523,914, and 4,137,585, and co-owned and co-pending U.S. patent applications entitled "Buoyancy Compensator with Expandable Cummerbund and Auxiliary Harness" and "Buoyancy Compensator with Interchangeable Accessories", Ser. Nos. 369,760 and 370,271, filed Jun. 22, 1989.

A buoyancy compensator is used by a scuba diver to adjust his buoyancy during a dive. The bladder can be inflated with air to increase the diver's buoyancy and deflated when the diver wants to descend to a lower level.

Previous buoyancy compensators are limited to a static functional configuration, as shown, for example, in U.S. Pat. Nos. 4,810,134 and 4,752,263. However, diving is a recreational sport and is therefore subject to the individual's interpretations as to its ultimate and most comfortable form. Diving encourages an individualistic approach governed by the diver's personality and the buoyancy compensator's adaptability.

SUMMARY OF THE INVENTION

The invention provides the first comprehensive approach to functional adaptability of a buoyancy compensator on the consumer level. The diver is free to choose the backpack and harnessing system which best suits his needs and preferences. A modular backpack and harnessing system enables the user to manipulate his tank support system to adapt his requirements and/or preferences through either an interchangeable soft or hard backpack or interchangeable cummerbund options. The buoyancy compensator includes a vest having an inflatable air cell, either a soft backpack or a hard backpack, and a cummerbund or waistband. The vest and cummerbund can be removably attached to the backpack. The cummerbund can have either a standard configuration or can include auxiliary harness supports.

The interchangeable backpack and cummerbund system further enhances the manufacturing of the buoyancy compensator. By separating the backpack and cummerbund from the manufacture of the vest, the sewing operator can produce subassemblies independently, thereby eliminating the labor involved in assembling the three components together. The final assembling step is transferred either to a manual assembly station within the manufacturing plant or to the point-of-purchase in the retail store where the modular components are selected according to the consumer's preferences.

DESCRIPTION OF THE DRAWING

The invention will be explained in conjuction with illustrative embodiments shown in the accomanying drawing, in which.

DESCRIPTION OF SPECIFIC EMBODIMENT

Figure 2:
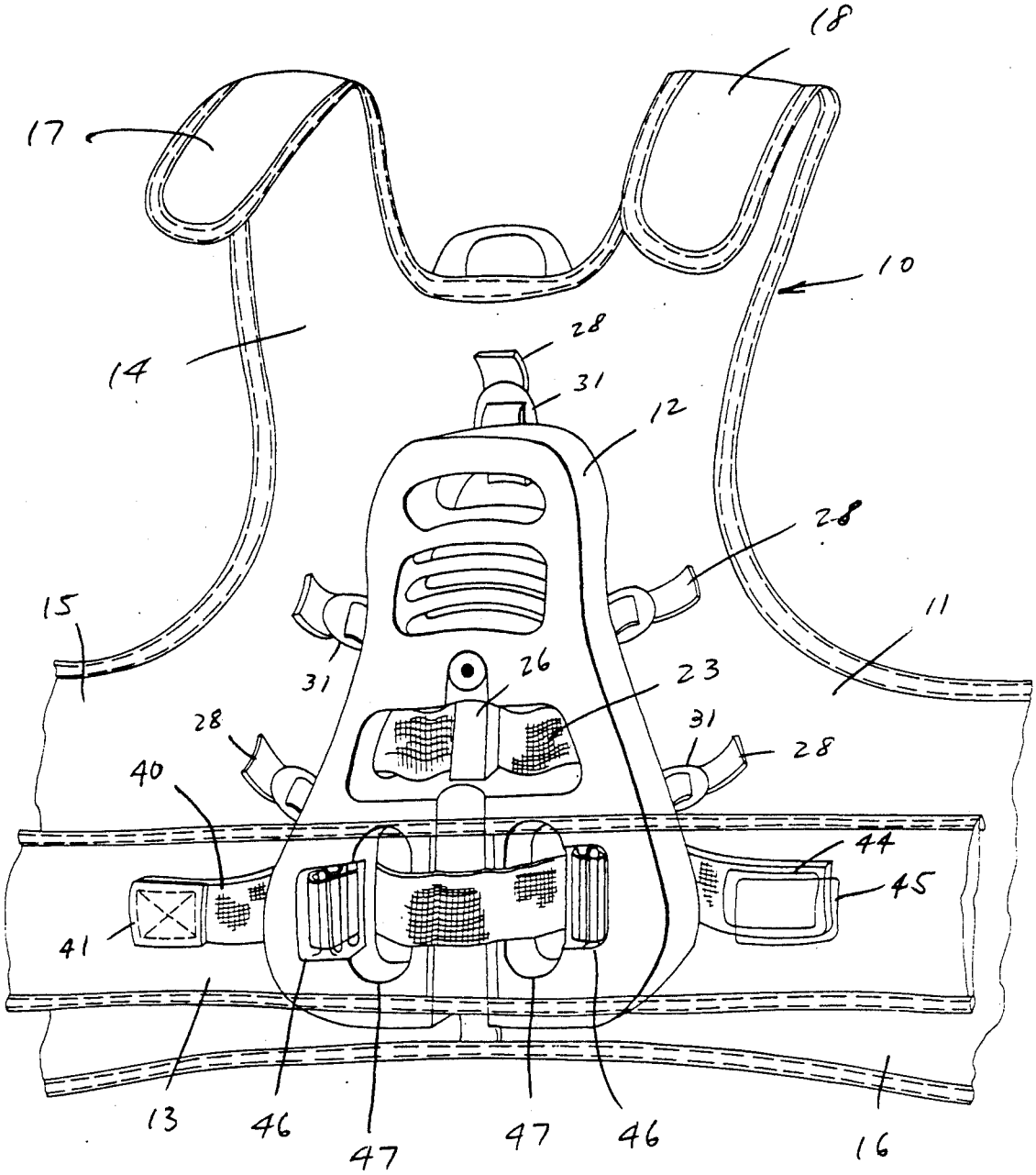
FIG. 2 is a perspective view of the hard backpack and cummerbund of FIG. 1 showing the attachment of the cummerbund to the backpact and a vest which is removably attached to the backpack.

Referring first to FIG. 2, the numeral 10 designates generally a buoyancy compensator which includes a vest 11, a hard backpack 12, and a cummerbund or waist band 13. The vest includes a back portion 14, right and left side lobes 15 and 16, and a right and left shoulder portion 17 and 18. The vest is equipped with conventional straps and backles (not shown) for connecting the side flaps and shoulder portions as described in copending U.S. patent applications entitled "Buoyancy Compensator with Expandable Cummerbund and Auxiliary Harness" and "Buoyancy Compensator with Interchangeable Accessories", Ser. Nos. 369,760 and 370,271, filed Jun. 22, 1989.

The vest is formed from two layers of nylon fabric 19 and 20 (FIG. 4) which are secured around their edges by a binding which is stitched to the fabric layers. The fabric layers enclose an air cell which is provided either by a conventional air bladder or by an air-impermeable layer on the inside of the fabric. In the latter case, the vest is formed from thermoplastic-coated nylon pack cloth which is electronically heat-sealed together. The bladder is inflated by a conventional inflator tube which is well known in the art.

The hard backpack 12 (FIG. 1) is conventional and includes a relatively rigid frame 21 and a tank harness 22 for supporting a tank of compressed breathing gas. The harness includes a strap 23 and a clamp 24 for tightening the strap and the tank against the frame. The strap is threaded through four slots 25 in the frame which are separated by bars 26 which are formed integrally with the frame.

Figure 4:
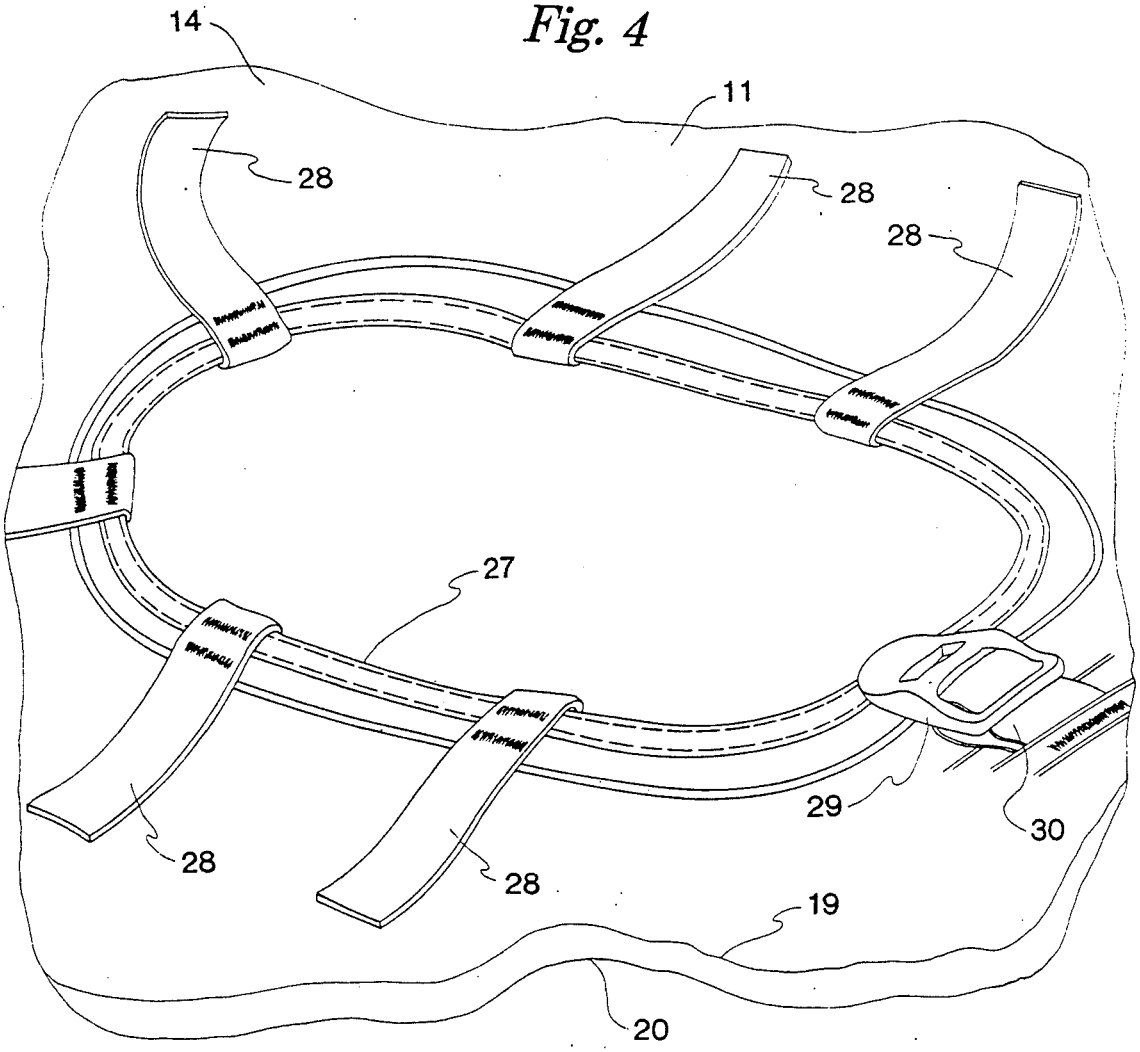
FIG. 4 is a fragmentary perspective view of the central portion of the back of the vest.

Referring to FIG. 4, the central portion of the back portion 14 of the vest 11 is provided with an opening 27 which is sized to fit generally around the periphery of the backpack frame 21. A plurality of flexible attaching straps 28, for example, of nylon web material, are attached to the vest around the opening 27, and a buckle 29 is attached to the bottom of the opening by a strap 30.

The vest is removably attached to the backpack frame 12 by threading the straps 28 through buckles 31 on the backpack frame and by securing the buckle 29 to a strap 32 (FIG. 5) on the frame. The buckles 31 are attached to the frame by flexible straps similar to the straps 28.

Figure 1:
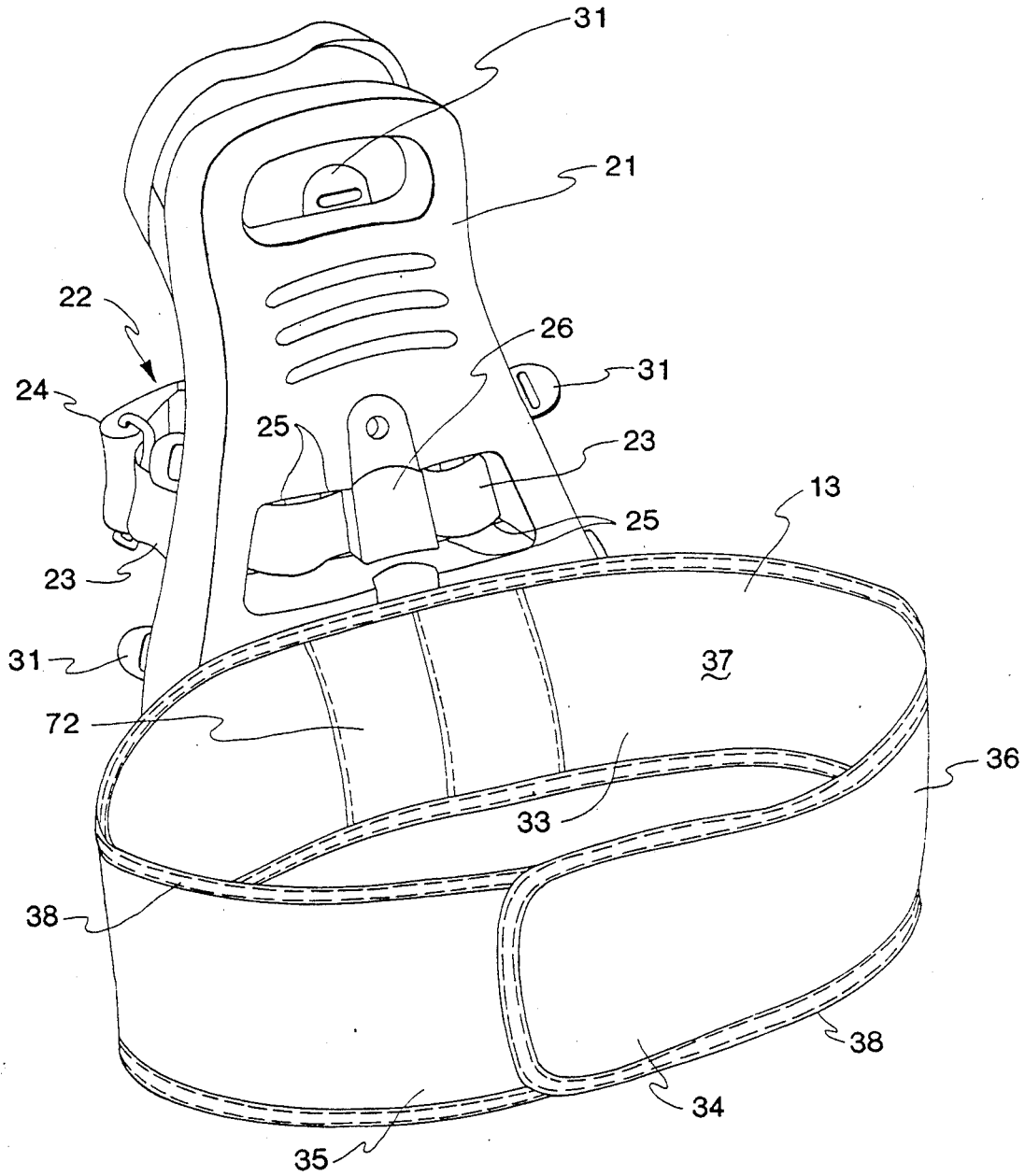
FIG. 1 is a perspective view of a hard backpack and a cummerbund removably attached to the backpack.

The cummerbund or waist band 13 includes a back or middle portion 33 (FIG. 1) and a pair of end portions 34 and 35. The end portions can be releasably secured together as shown in FIG. 1 by complementary hook and loop fasteners of the type which are sold under the trademark Velcro. The cummerbund is advantageously formed from inner and outer layers 36 and 37 of non-elastic nylon fabric and edge bindings 38 which are stitched to the edges of the nylon fabric.

Figure 3:
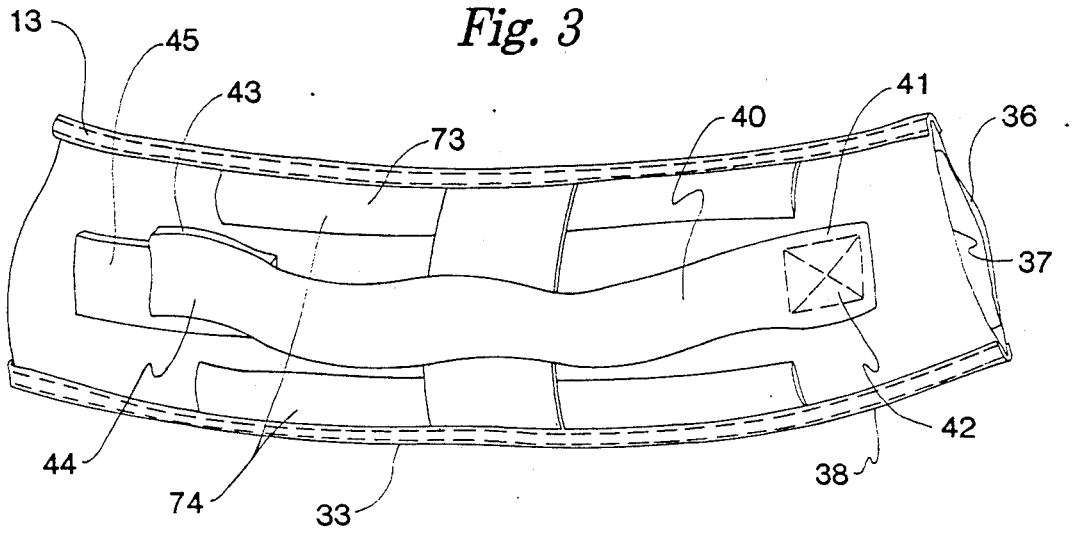
FIG. 3 is a fragmentary perspective view of the back or outer surface of the cummerbund.

The cummerbund is removably secured to the backpack frame 21 by a flexible attaching strap 40 (FIGS. 2 and 3). One end 41 of the strap is permanently attached to the outer layer of the cummerbund by stitching 42. A hook and loop fastener 43 is attached to the free end 44 of the strap and mates with a complementary hook and loop fastener 45 on the cummerbund. The flexible attaching strap 40 is threaded through two small slots 46 and two large slots 47 in the backpack frame, and the end 44 of the strap is secured to the cummerbond by the fasteners 43 and 45.

Figure 5:
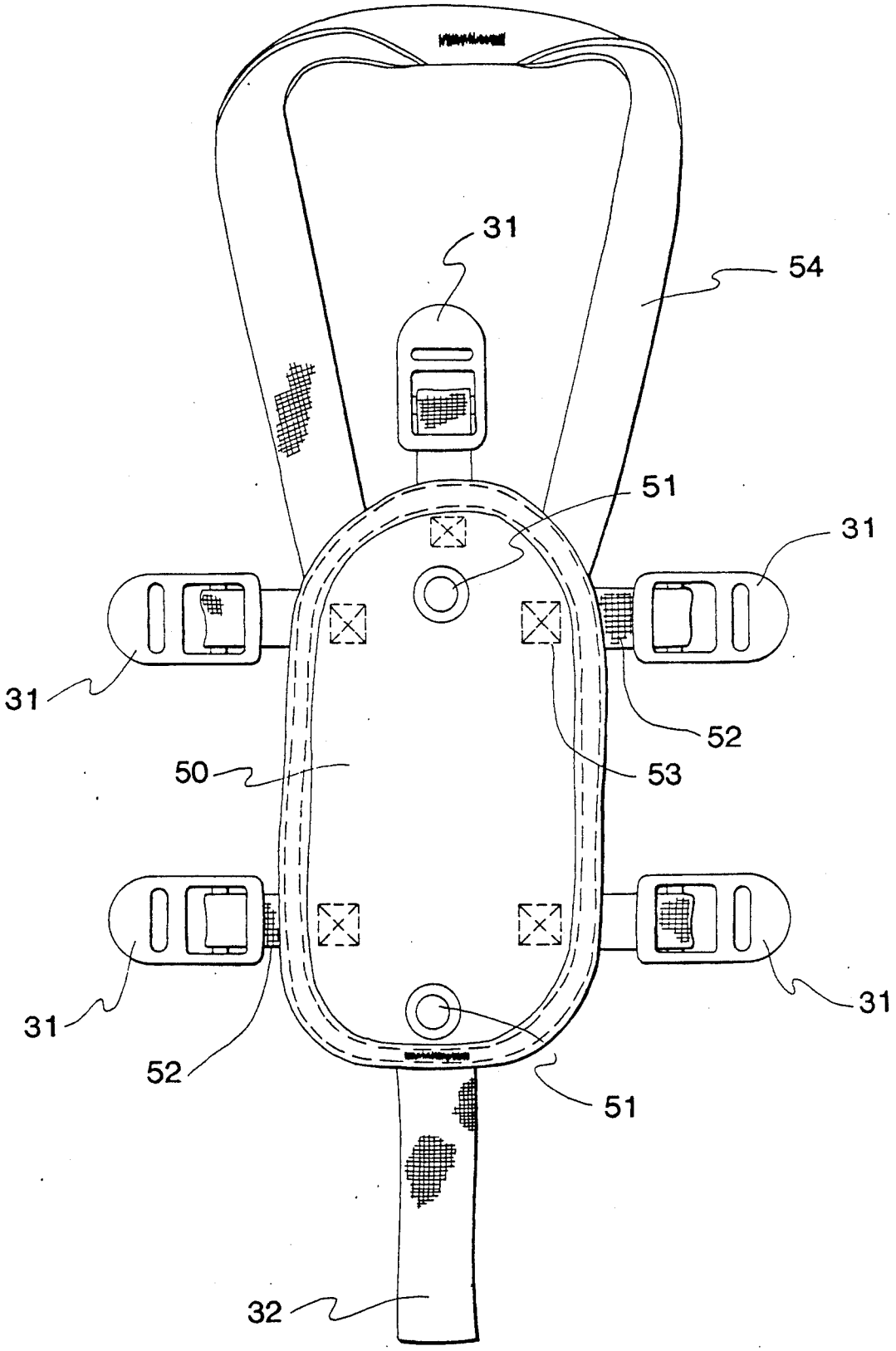
FIG. 5 illustrates a center panel assembly for the hard backpack.

FIG. 5 illustrates a fabric center panel 50 which can be used to mount the buckles 31 and strap 32 on the hard backpack 12. The panel 50 can be mounted between the frame 21 of the backpack and the conventional curved backing plate which is attached to the frame and against which the breathing tank is clamped by the harness 22. The panel is provided with bolt holes 51 for the bolts which attach the backing plate to the frame.

Figure 10:
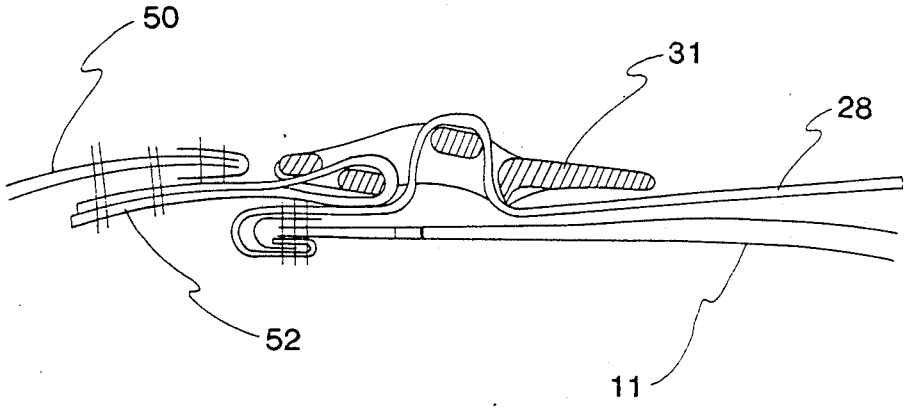
FIG. 10 is a sectional view of one of the attaching straps and backles.

Each of the buckles 31 is attached to the panel 50 by flexible straps 52 which are stitched to the panel by stitching 53. A handle strap 54 is also attached to the panel to facilitate carrying the backpack when the breating tank is mounted. FIG. 10 is a sectional view through one of the straps 28 and buckles 31.

Figure 6:
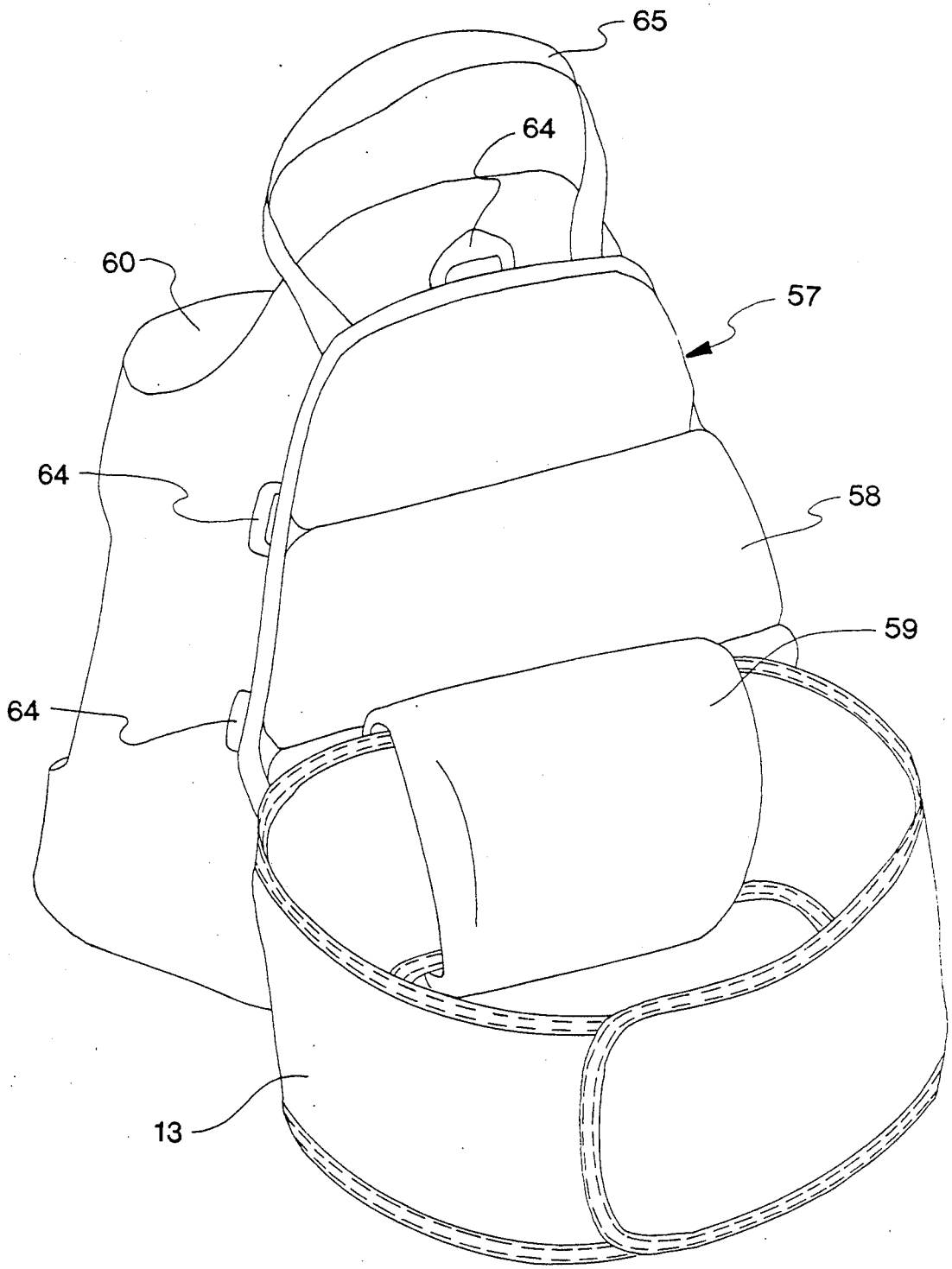
FIG. 6 is a perspective view of a soft backpack and the cummerbund.

FIG. 6 shows the cummerbund 13 removably attached to a soft backpack 57. The soft backpack includes a back pad 58 and a lumber pad 59 which is attached to the lower portion of the back pad. A conventional tank harness 60 (see also FIG. 9) is secured to the back pad for supporting a breathing tank 61. The tank harness includes straps 62 and buckles 63 for securing the tank. A handle 65 is provided for carrying the backpack.

The vest 11 is removably attached to the soft backpack by threading the straps 28 (FIG. 4) which are secured around the center opening of the vest to buckles 64 on the backpack and by securing the buckle 29 on the vest to a strap on the backpack.

Figure 7:
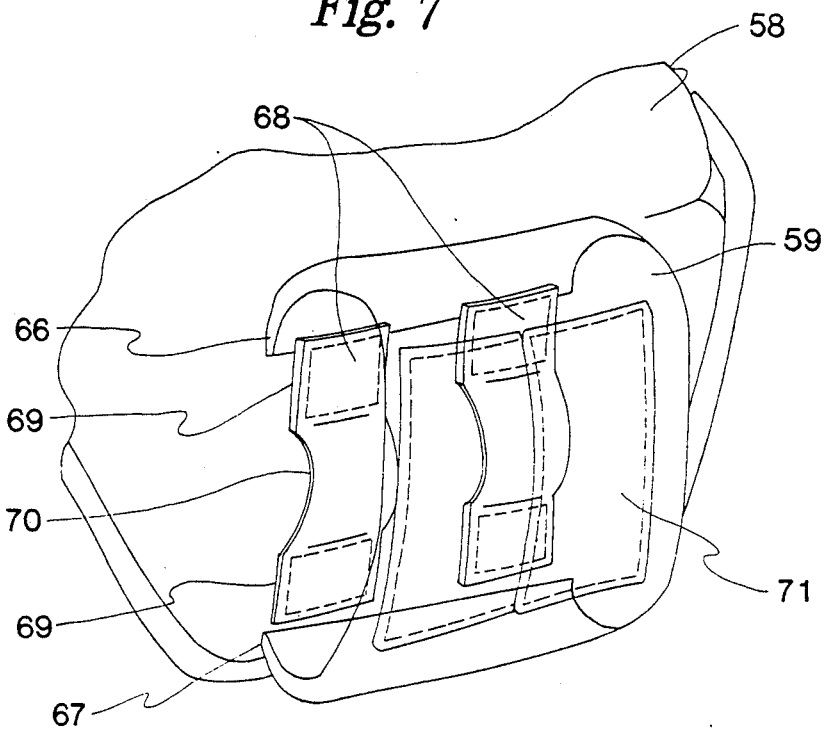
FIG. 7 is a fragmentary perspective view illustrating the means for removably attaching the cummerbund to the soft pack.

Referring to FIG. 7, the lumbar pad 59 includes upper and lower edges 66 and 67 which are stitched to the back pad 58 and form a collar or sleeve through which the cummerbund 13 may be inserted. A pair of attaching straps 68 extend perpendicularly to the cummerbund and include end portions 69 which are stitched to the back pad and middle portions 70 which are not secured to the pad. The outer surfaces of the straps 68 are formed of hook and loop material. A pad 71 of hook and loop material is secured to the inside surface of the lumbar pad.

Referring to FIGS. 1 and 3, a pad 72 of hook and loop material is attached to the inside surface of the cummerbund and is adapted to mater with the fastening pad 71 on the lumber pad. Strips 73 and 74 of hook and loop fastening material are attached to the outside surface of the cummerbund and are adapted to mater with the straps 68.

The cummerbund is removably attached to the soft backpack by inserting the cummerbund between the back pad 58 and the lumbar pad 59, inserting the flexible attaching strap 40 on the cummerbund between the midportions 70 of the straps 68 and the backpack and securing the end 44 of the strap 41 to the fastening pad 45 on the cummerbund, and securing the complementary fasteners 71 and 72 and 73, 74, and 68. The fasteners thereby provide a tri-level redundancy and ensure the safety of the system's long term operation.

Figure 8:
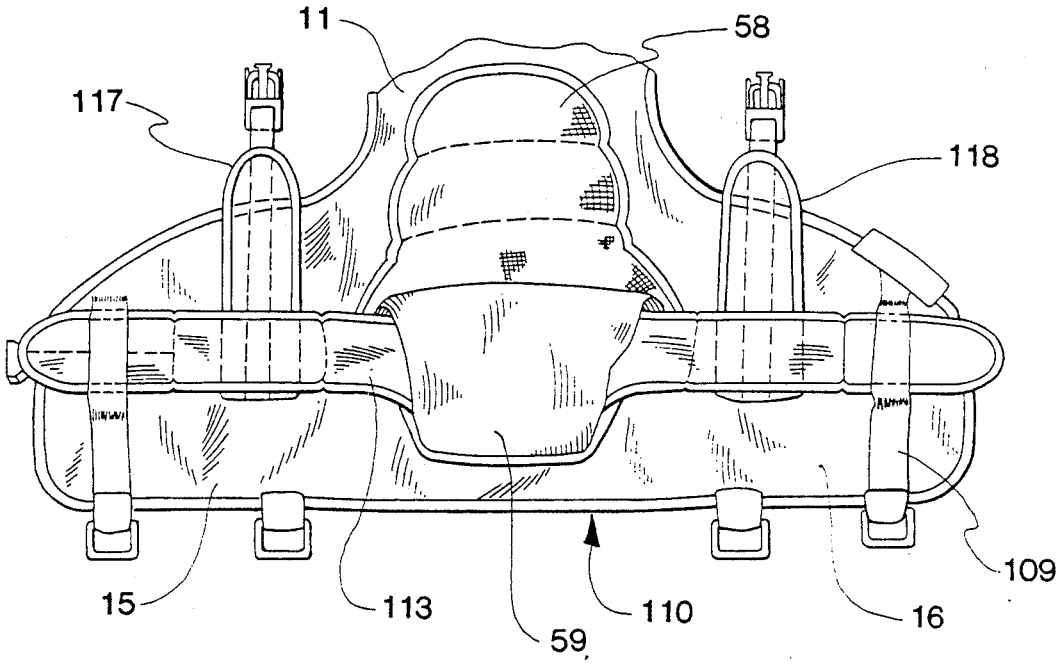
FIG. 8 illustrates a soft backpack, a vest, and a cummerbund with auxiliary harness straps.
Figure 9:
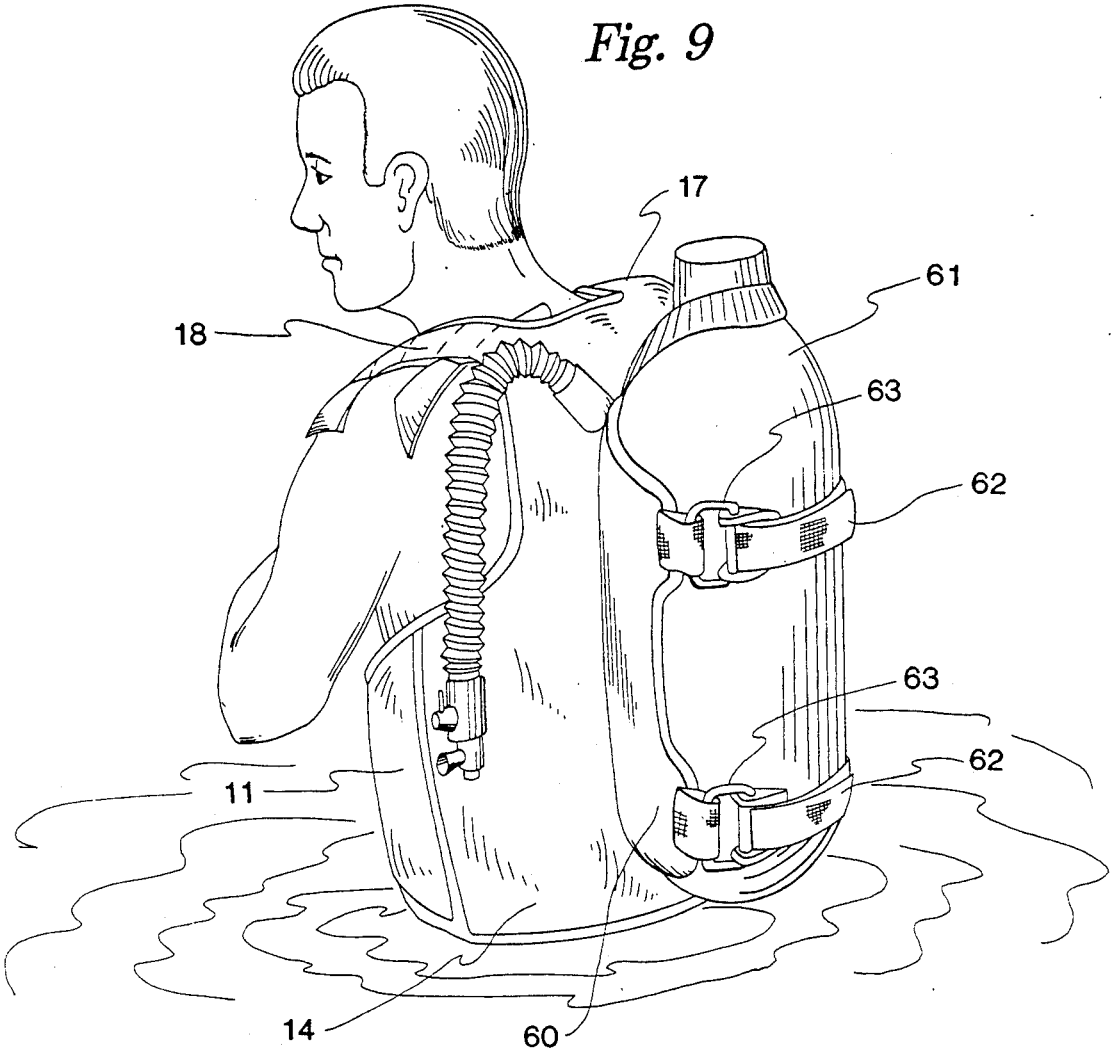
FIG. 9 is a perspective view of a diver wearing the buoyancy compensator of FIG. 8.

FIG. 8 illustrates a buoyancy compensator 110 which is similar to the soft pack buoyancy compensator illustrated in FIGS. 6 and 9 except that the commerbund 113 includes auxiliary right and left harness straps 117 and 118 which extend upwardly toward the right and left shoulder portions 17 and 18 of the vest. A complete description of the cummerbund with auxiliary harness straps may be found in co-pending United States application entitled "Buoyancy Compensator with Expandable Cummerbund and Auxiliary Harness," Ser. No. 369,760, filed Jun. 22, 1989. A similar commerbund with auxiliary harness straps can also be used with the hard backpack illustrated in FIGS. 1 and 2.

It will be understood from the foregoing description that a diver can choose the backpack and cummerbund system which best suits his specific needs and preferences. The possible combinations include the standard cummerbund illustrated in FIG. 1 with a hard backpack, the standard cummerbund with a soft backpack (FIG. 6), the harness cummerbund illustrated in FIG. 8 with a hard backpack, and the harness cummerbund with a soft backpack. The vest, backpack, and cummerbund components of the buoyancy compensator are detachable and interchangeable and need not be assembled until the diver makes his choice at the point-of-purchase.

While in the foregoing specification detailed description of specific embodiments of the invention were set forth for the purpose of illustration, it will be understood that many of the details herein given may be varied considerably by those skilled in the art without departing from the spirit and scope of the invention.

I claim:

1. A buoyancy compensator assembly comprising a vest having an inflatable air cell, a backpack removably attached to the vest, the backpack including means for supporting a breathing tank and an attaching member, and a cummerbund removably attached to the backpack and adapted to encircle the waist of a wearer, the cummerbund including a flexible attaching strap having one end secured to the cummerbund and securing means on the other end of the attaching strap and on the cummerbund, the attaching strap (being threaded through) the attaching member on the backpack and secured to the cummerbund by the securing means.

2. The assembly of claim 1 in which said securing means comprises a hook and loop fastener on said other end of the attaching strap and a complementary hook and loop fastener on the cummerbund.

3. The assembly of claim 1 in which the backpack includes a sleeve through which the cummerbund extends and the cummerbund includes an outside surface facing the backpack and an inside surface adapted to face the wearer, said flexible attaching strap being attached to the outside surface of the cummerbund, a hook and loop fastener attached to the inside surface of the cummerbund, and a complementary hook and loop fastener attached to the inside of the sleeve for removably attaching the cummerbund.

4. The assembly of claim 3 in which the attaching member on the backpack comprises a strap which extends generally perpendicularly to the cummerbund and includes a pair of ends which are secured to the backpack.

5. The assembly of claim 4 including hook and loop fasteners on the ends of the strap on the backpack and complementary hoot and loop fasteners on the outside surface of the cummerbund.

6. The assembly of claim 3 in which the attaching member on the backpack comprises a pair of straps which extend generally perpendicularly to the cummerbund, each of the straps including a pair of ends which are secured to the backpack.

7. The assembly of claim 1 in which the backpack includes a rigid frame and the attaching member on the backpack is provided by a plurality of slots in the frame, the attaching strap on the cummerbund being threaded through the slots in the frame.

8. The assembly of claim 1 in which the vest is provided with an opening in which the backpack is positioned and the vest and the backpack include attaching members for removably attaching the backpack to the vest.

9. A backpack assembly comprising a vest having an inflatable air cell, a relatively rigid backpack frame removably attached to the vest, the backpack frame including means for supporting a breathing tank, a cummerbund removably attached to the backpack frame and adapted to encircle the waist of a wearer, the cummerbund having an inside surface facing the wearer and an outside surface facing the backpack frame, a flexible attaching strap having one end secured to the outside surface of the cummerbund, the flexible attaching strap extending through a plurality of slots in the backpack frame the other end of the flexible attaching strap being removably secured to the outside surface of the cummerbund.

10. The assembly of claim 9 including a hook and loop fastener on said other end of the flexible attaching strap and a complementary hook and loop fastener on the outside surface of the cummerbund for removably securing the other end of the flexible attaching strap to the cummerbund.

11. The assembly of claim 9 in which the vest is provided with an opening in which the backpack is positioned, a plurality of attaching straps on the vest, and a plurality of fastening means on the backpack frame for fastening the attaching straps on the vest.

12. A backpack assembly comprising a vest having an inflatable air cell, a soft backpack removably attached to the vest, the backpack including means for supporting a breathing tank, a strap having a pair of ends which are secured to the backpack and a central portion which is unsecured to the backpack, a sleeve overlying said strap and secured to the backpack, a cummerbund extending through said sleeve between the sleeve and the strap and adapted to encircle the waist of a wearer and having an inside surface facing the wearer and an outside surface facing the backpack, a flexible attaching strap having one end secured to the outside surface of the cummerbund and extending beween the unsecured central portion of the strap attached to the backpack, the other end of the flexible attaching strap being removably secured to the outside surface of the cummerbund.

13. The assembly of claim 12 including a hook and loop fastener on said other end of the flexible attaching strap and a complementary hook and loop fastener on the outside surface of the cummerbund for removably securing the other end of the flexible attaching strap to the cummerbund.

14. The assembly of claim 12 including a hook and loop fastener attached to the inside surface of the cummerbund and a complementary hook and loop fastener attached to the inside of the sleeve for removably attaching the cummerbund to the sleeve.

15. The assembly of claim 12 including hook and loop fasteners on the ends of the strap on the backpack and complementary hook and loop fasteners on the outside surface of the cummerbund.

16. The assembly of claim 12 including attaching straps on the vest and fastener means on the backpack for fastening the attaching straps on the vest.

* * * * *

UNITED STATES PATENT AND TRADEMARK OFFICE

CERTIFICATE OF CORRECTION

PATENT NO. : 5,046,894

DATED : September 10, 1991

INVENTOR(S) : Neil R. Bergstrom

It is certified that error appears in the above-identified patent and that said Letters Patent is hereby corrected as shown below:

Col. 4, line 56 change "(being threaded through)" to --being threaded through--.

Col. 5, line 12 change "hoot" to --hook--.

Col. 6, line 21 change "beween" to --between--.

Signed and Sealed this

Twenty-second Day of December, 1992

*Attest:*

DOUGLAS B. COMER

*Attesting Officer*

*Acting Commissioner of Patents and Trademarks*